US005794484A

United States Patent [19]

Jaddou

[11] Patent Number: 5,794,484

[45] Date of Patent: Aug. 18, 1998

[54] UNIVERSALLY MAKING WAVED PARTS

[75] Inventor: John Yas Jaddou, Warren, Mich.

[73] Assignee: Ford Global Technologies, Inc., Dearborn, Mich.

[21] Appl. No.: 155,877

[22] Filed: Nov. 23, 1993

[51] Int. Cl.[6] ..... B21D 13/02

[52] U.S. Cl. ..... 72/414; 72/379.6; 29/896.9

[58] Field of Search ..... 72/412–416, 385, 72/379.2, 379.6; 29/173, 896.9

[56] References Cited

U.S. PATENT DOCUMENTS

| | | | |
|---|---|---|---|
| Re. 14,759 | 11/1919 | Wilcox | 72/469 |
| Re. 77,785 | 8/1930 | Wuerfel . | |
| 258,382 | 5/1882 | Creagan et al. | 72/413 |
| 462,647 | 11/1891 | Bidwell | 72/413 |
| 483,094 | 9/1892 | Ansted | 72/413 |
| 1,452,499 | 4/1923 | Flinn | 72/379.2 |
| 1,668,297 | 5/1928 | Wuerfel . | |
| 1,759,234 | 5/1930 | Layne | 72/385 |
| 2,689,539 | 9/1954 | Lyon | 72/413 |
| 2,860,869 | 11/1958 | Utvitch . | |
| 3,748,888 | 7/1973 | Gerich | 72/385 |
| 4,212,188 | 7/1980 | Pinson | 72/413 |
| 4,339,941 | 7/1982 | Taira et al. | 72/412 |
| 5,125,252 | 6/1992 | Ayres et al. | 72/413 |

FOREIGN PATENT DOCUMENTS

| | | | |
|---|---|---|---|
| 159905 | 8/1903 | Germany | 72/413 |
| 1452652 | 9/1970 | Germany | 72/385 |
| 128338 | 10/1980 | Japan | 72/414 |
| 1523218 | 11/1989 | U.S.S.R. | 72/385 |
| 1565560 | 5/1990 | U.S.S.R. | 72/413 |
| 888636 | 1/1962 | United Kingdom | 72/385 |
| 996948 | 6/1965 | United Kingdom | 72/414 |

*Primary Examiner*—Daniel C. Crane
*Attorney, Agent, or Firm*—Joseph W. Malleck

[57] ABSTRACT

Method of universally making waved parts by (a) providing a plurality of wave forming blocks each having a working surface in the form of a conical segment; (b) removably securing a plurality of such blocks to two arcuate supports (preferably discs) with the blocks spaced apart and with the axis of revolution of the block working surfaces aligned with the radius of the support to create a support-block assembly; and (c) facing and accurately bringing together such support-block assemblies with a deformable material (i.e., spring steel) therebetween, the blocks of one support being superimposed over the spaces between the blocks of the other support.

4 Claims, 5 Drawing Sheets

UNIVERSALLY MAKING WAVED PARTS

BACKGROUND OF THE INVENTION

1. Technical Field

This invention relates to devices and methods for making waved parts and more particularly to flexible dies that are not dedicated to making a single sized part and a single set of wave characteristics.

2. Discussion of the Prior Art

In making waved parts, current commercial practice requires 2–4 months to produce such parts from a given engineering drawing. Any modification to the drawing by the designer requires an additional delay of several months. Such time periods are caused by the need to meticulously design, machine and remachine the waves by empirical trial and error until the desired wave characteristic is achieved. The resulting wave die is thus dedicated to a specific number of waves, offering a specific spring rate if used to make a wave spring, and dedicated to a specific inside and outside diameter ring or disc. In the evolving world of rapid prototyping and rapid production design for parts such as friction plates for automatic transmissions of automotive vehicles, such constraints are unacceptable.

Although attempts have been made to make dies or presses adjustable, such as presses used to make wheel covers, such attempts have proved to be cumbersome and complex and would be unsuitable to wave part production. In the relevant wave spring making art, dedicated dies is the standard practice (see U.S. Pat. No. 1,668,297 and reissue Pat. No. 77,785).

SUMMARY OF THE INVENTION

It is an object of this invention to provide a method and die for universally waving parts that is highly economical and permits the part to be redesigned and fabricated in a matter of hours.

A first aspect of this invention is a method of universally making waved parts which comprises: (a) providing a plurality of wave forming blocks having a working surface in the form of a conical segment with each segment having an axis of revolution associated therewith; (b) securing a plurality of such blocks to at least two arcuate supports with the axis of revolution of the blocks aligned with the arcuate radius of the support to create support-block assemblies; and (c) facing and accurately bringing together such support-block assemblies with a deformable material therebetween, the blocks of one support being superimposed over the spaces between the blocks of the other.

Another aspect of the invention is a universal die assembly which comprises: (a) first and second arcuate support plates superimposed and facing each other; and (b) a plurality of wave forming blocks secured to the facing surface of each of said support plates; the blocks each having a working surface formed as a segment of a conical surface of revolution, each block having its axis of revolution aligned with the arcuate radius of the support plate, and the blocks being spaced and secured to dovetail with opposing blocks when the support plates are brought together.

Yet still another aspect of this invention is a method of using a universal die, which comprises: (a) providing the die assembly previously described; (b) aligning the center of a deformable material with the center of the support, the material being interleaved between the facing dies of the die assembly; (c) pressing the die assemblies together at room temperature to cold work the deformable material therebetween beyond the elastic region of the material; (d) continuing to load the die assemblies to maintain a constant force on the deformable material for at least 30 seconds in the plastic region; (e) relaxing the load on said material and repressing the material to a flat condition; and (f) repeating the pressing of the material between the die assemblies to produce a desired number of waves to a desired profile-contour.

DETAILED DESCRIPTION AND BEST MODE

Figure 1:
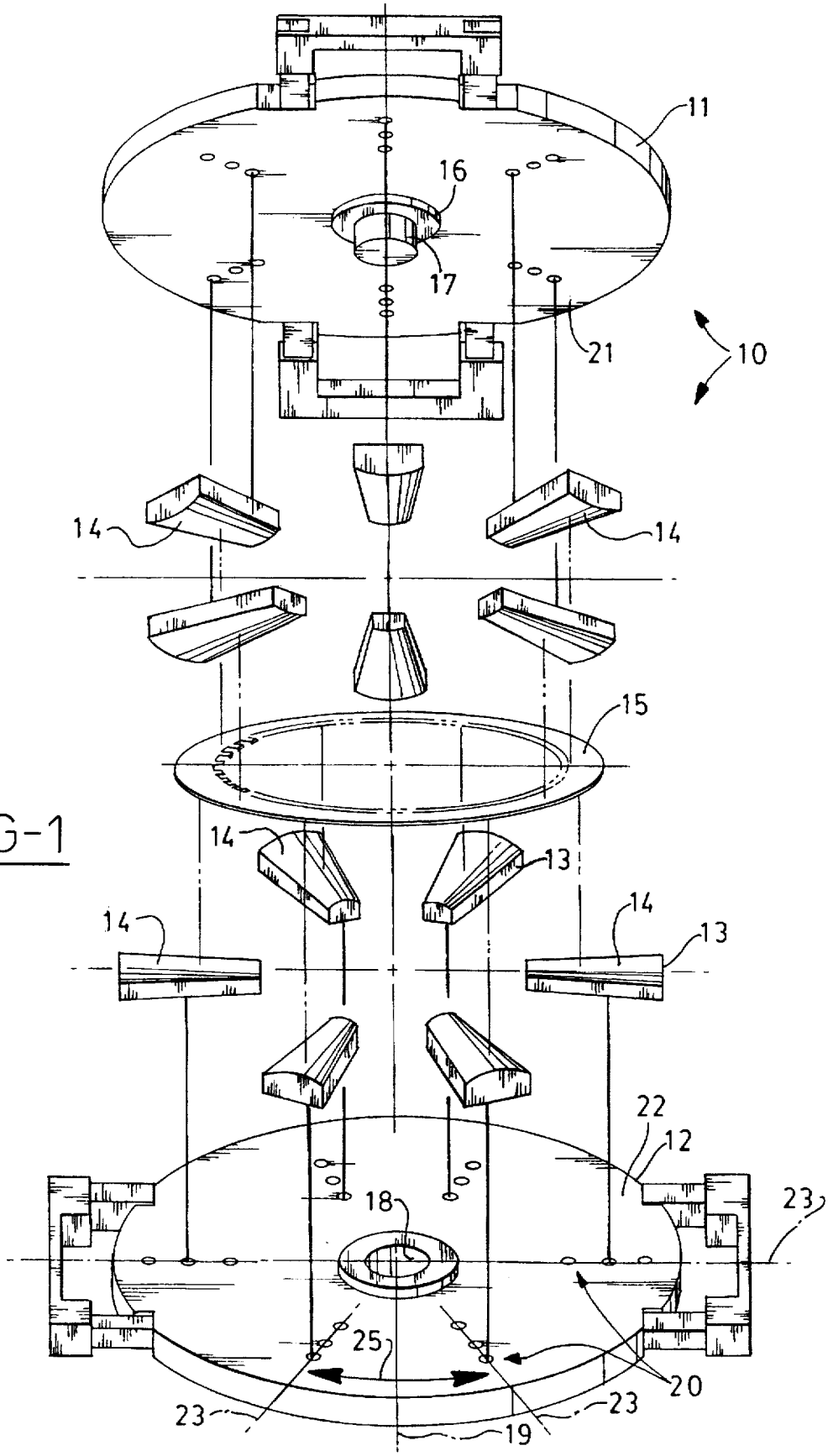
FIG. 1 is an exploded perspective view of the die assembly of this invention.
Figure 2:
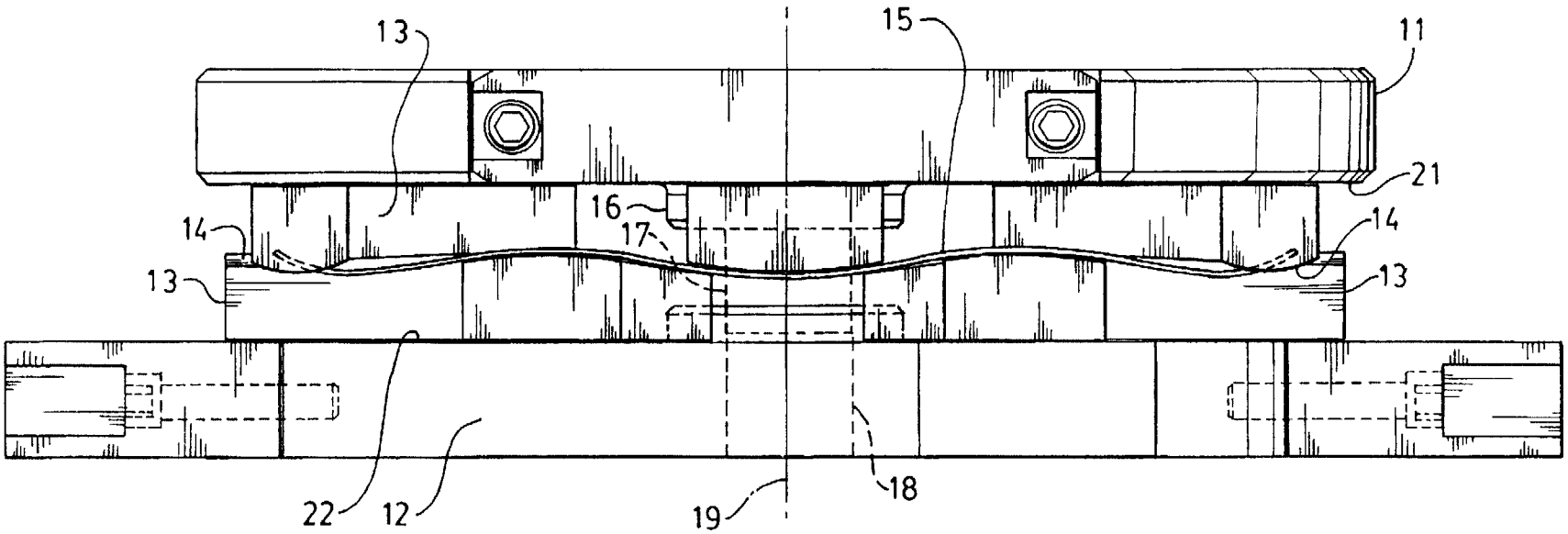
FIG. 2 is an elevational view of the die assembly schematically represented in a press for applying the proper load to the die assembly.
Figure 3:
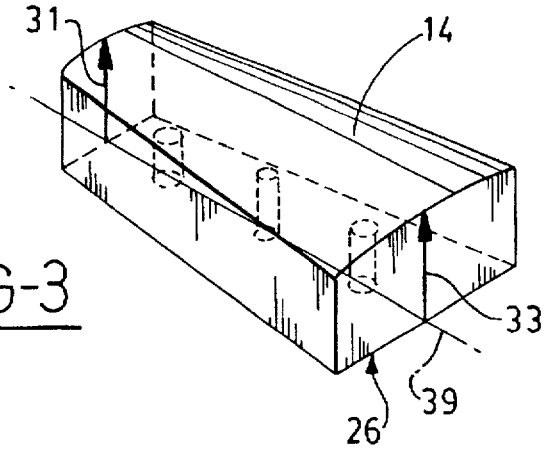
FIGS. 3, 4, 5, 6 and 7 are respectively perspective, rear, side, front and plan views of a typical block having a segmented conical working surface.
Figure 7:
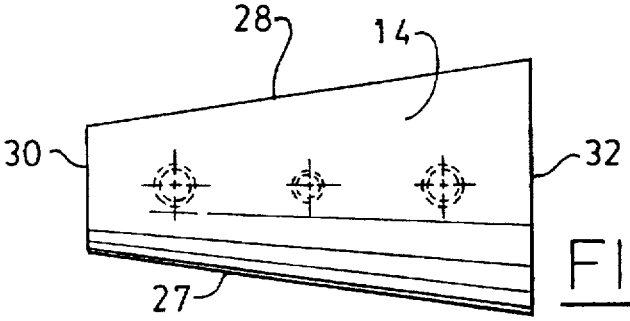
Figure 6:
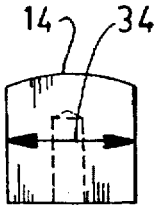
Figure 5:
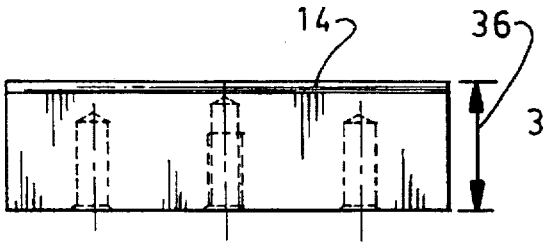
Figure 4:
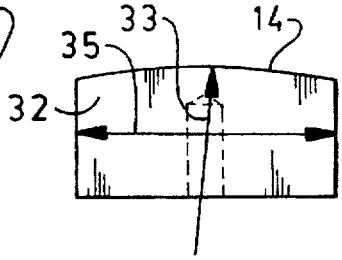

The universal die assembly 10 of this invention, as shown in FIGS. 1 and 2, comprises a pair of facing superimposed support plates 11 and 12 to each of which is secured a plurality of blocks 13 carrying segmented conical forming surfaces 14. The blocks of one plate are out of axial superimposed phase with the blocks of the other plate thereby to form waves in a deformable material 15 placed therebetween.

Each support plate has at least an arcuate shape, preferable a disc shape. The plates are constituted of a rigid material such as steel (AISI-4340) or ceramic, i.e. silicon carbide or beryllium carbide having a strength of at least 500 MPa to withstand bending forces used to shape the deformable material 15. The upper plate 11 has a central neck 16 with a depending centering pin 17 to be received in a complimentary centering receptacle 18 of the lower plate 12, the receptacle being concentric with the axis 19 of the assembly. Sets 20 of aligning and securing openings are formed in the facing surfaces 21, 22 of the respective plates. For example, to provide a die that can make up to 16 waves in an annular part, the radiating center lines 23 of the sets are spaced, at 25, equally angularly apart a modular amount of 22.5°. Then, if a 8 wave part is to be formed, only the sets which are spaced 45° apart are used, for a 4 wave part only sets that are 90° apart are selected, and for a 2 wave annular part only sets 180° apart are selected. If the modular spacing of such sets is selected to be 15°, the annular part may be given as many as 24 waves equally angularly spaced or as little as 3 waves.

Figure 11:
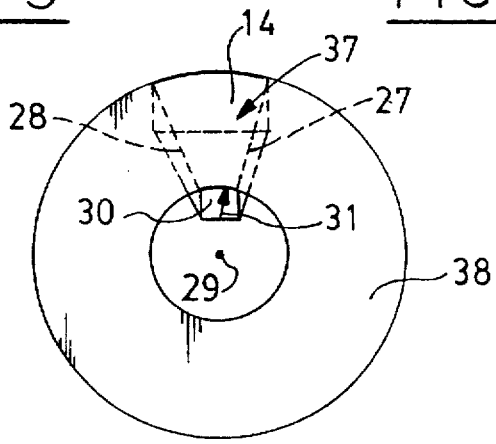
FIG. 11 is a frontal perspective diagram of a cone showing how the working surface of a block is a segment thereof.

The conical forming or working surface 14 of each block 13 is created by machining one side of a wedge shaped member 26 according to instructions of a CNC milling machine. The CNC machine duplicates a truncated segmented 37 of the surface of a cone 38 (see FIG. 11), the segment having straight sides 27, 28 radiating from the cone apex 29. Each block will have a small end 30 with a smaller working surface radius 31 (i.e. about 60–80 mm), and a large end 32 with a greater working surface radius 33 (i.e. about 100–120 mm). As shown in FIGS. 3–7, each block will have a width 34 at the small end of about 38 mm and a width 35 at the large end of about 18 mm. The height 36 of each block is uniform and is desirably selected to be in the range of 5–30 mm so that the part can be deformed freely without encountering the support disc. The radii 31 and 33 of the conical working surface is selected to reduce contact stresses when forming, and the length of each block can be any practicable length suited to the application.

Figure 10:
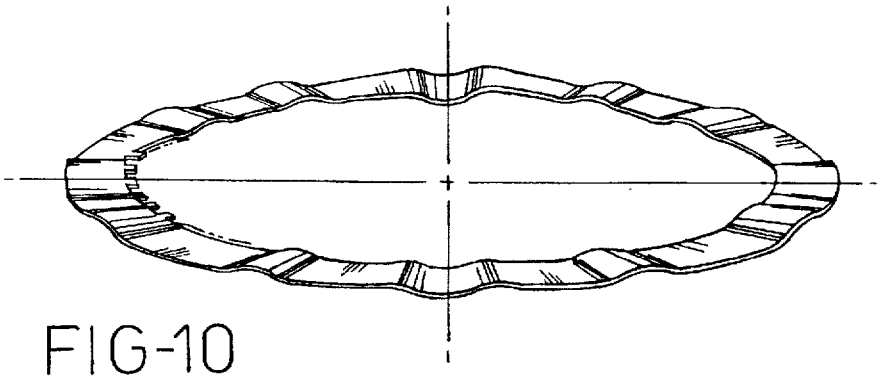
FIG. 10 is a perspective view of a friction plate or spring end product produced by the method of this invention.

The deformable material 15 can be in the shape of an arc, a ring, or a disc as long as the material is plastically deformable at room temperature. Preferably the material is a metal that can act as a resilient spring utilizing waves to resist resiliently the flattening of the waves and thereby function as a spring. Deformable materials can be selected from the group of metals, polymers, and metal composites. In the mode disclosed, a friction ring is formed with waves useful in a automatic transmission for an automotive vehicle (see FIG. 10). Each such ring has a radially inner circumference 37 (at a radius of about 5.6 mm) and a radially outer circumference 38 (at a radius of about 6.8 mm).

Figure 8:
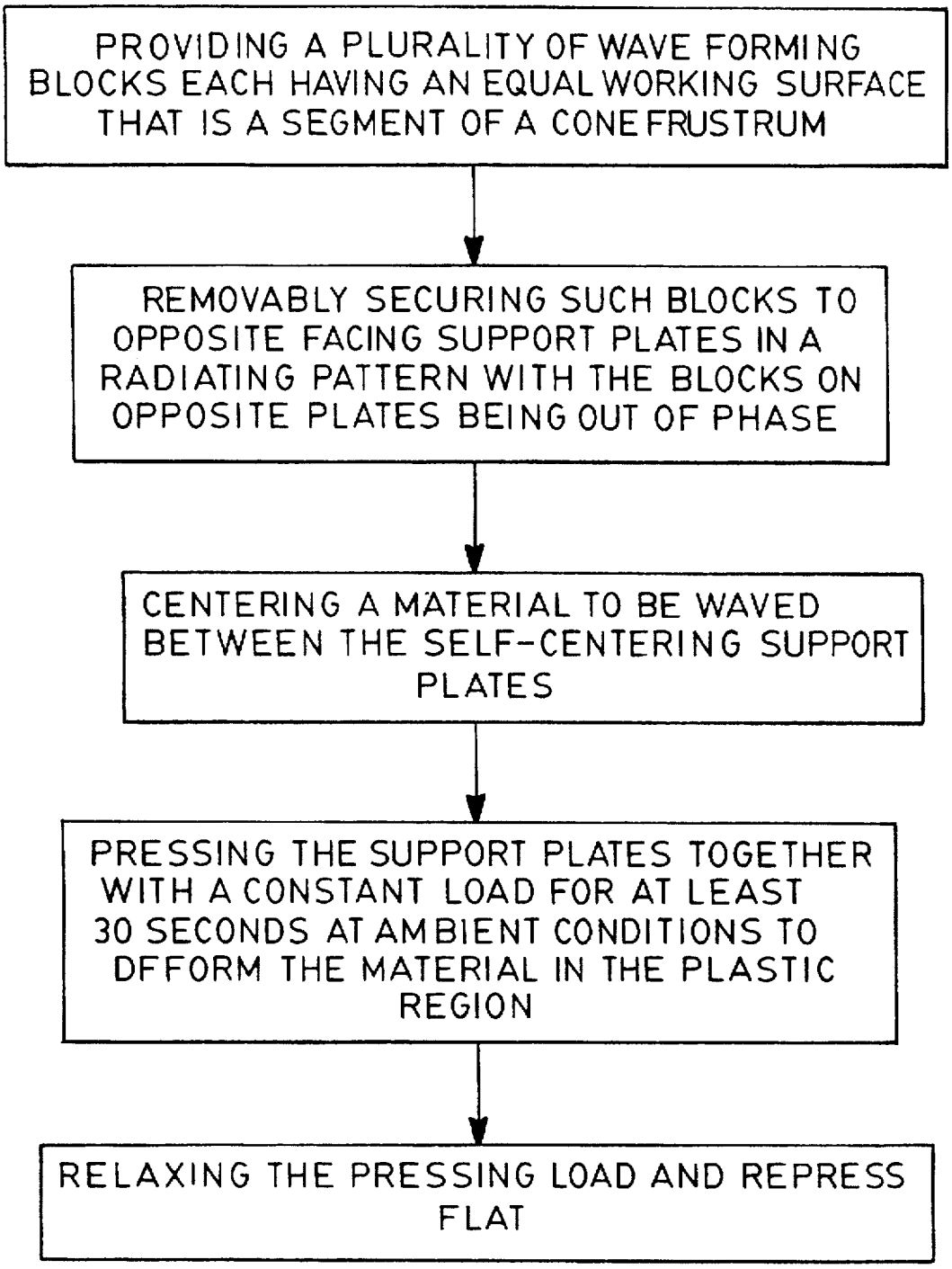
FIG. 8 is a schematic flow diagram of the method of this invention.

As shown in FIG. 8, the method aspect of this invention for universally making waved parts, comprises essentially five steps. First a plurality of wave forming blocks 13 is provided, each having a working surface 14 in the form of a conical segment and each having an axis of revolution 39 associated therewith. Secondly, a plurality of such blocks are removably secured to at least two arcuate supports 11, 12 with the blocks spaced apart at 25 and with the axis of revolution 39 of the blocks aligned with the radius of the support to create a support-block assembly. The removability is achieved by use of removable pins 40 located in inner and outer openings 41, 42 of each set 20, and by the use of a removable threaded fastener 43 in the center opening 44 of set 20. Thirdly, the support-block assemblies are accurately brought together facing each other with a deformable material 15 therebetween, the blocks of one support being superimposed over the spaces between the blocks of the other support. The material is centered with respect to the supports and blocks so as to be in accurate axial alignment therewith. Preferably the material is centered between the support plates by a self-centering appendage (pin 17 and receptacle 18) to the support-block assemblies.

Figure 9:
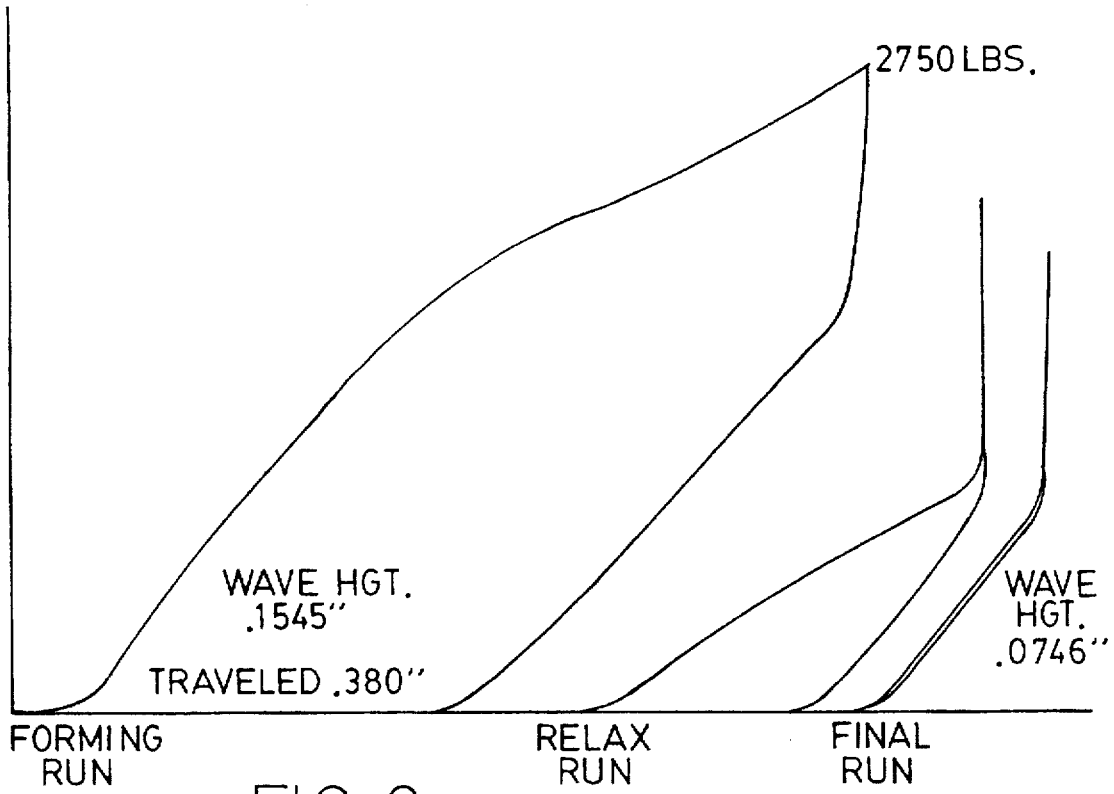
FIG. 9 is a graphical illustration of the load characteristics of the part.

Fourthly, the support-block assemblies are forced together with a pressure that is effective to deform the flat material therebetween as the blocks dovetail with respect to each other; that is, the blocks are out of phase to mesh within the valleys between blocks of the opposing assembly. The force is sufficient to cold work the material beyond the elastic region thereof and is carried out at a constant load for at least 30 seconds (see forming run in FIG. 9). Fifthly, the load is relaxed and the deformed material is pressed to a flat condition to eliminate the high degree of springback (see relax run in FIG. 9). Repressing the spring in a final run shows the spring deflection to be the same in both applying and removing forces.

The above pressing and relaxing sequence may be repeated to produce a desired number of waves and to produce a desired profile-contour. Any suitable press may be utilized to apply the pressure to the die assembly. The force levels that are typically used for deforming metal spring material, such as for the part in FIG. 10, having a thickness in the range of 0.5 mm to 5.0 mm, is about 2750 lbs. The forming run will deflect to about 0.38 inches. The finally formed spring will have a maximum deflection of about 20 mm and will resist a load of 6700 N.

I claim:

1. A method of using a universal waving die, comprising:

(a) providing a die assembly having a plurality of wave forming blocks each with a working surface in the form of a conical segment and each segment having an axis of revolution defining said surface with differing radii at the radial ends of the blocks, the plurality of blocks being removably secured to at least two flat plates with the blocks spaced apart and with the axis of revolution of said blocks aligned with the radius of the plates;

(b) aligning a deformable arcuate material with the center of said plates;

(c) pressing said die assembly together with said deformable material interleaved therebetween at room temperature to cold work the material beyond the elastic region thereof and form waves in such material;

(d) continue to apply loading to said deformable material at a constant level for at least 30 seconds;

(e) relax said load and press the deformed material to a flat condition;

(f) allow the material to assume its semi-deformed shape and repeat pressing between the die assemblies if the shape is not to the desired number of waves and profile height; and (g) securing at least some of said blocks in at least one of a new radial location on said plates or in a new circumferential spacing on said plates, and repeating steps (b)–(f).

2. The method as in claim 1, in which said working surface is a truncated segment of a cone having an inner radius in the range of 60–80 mm and an outer radius in the range of 100–120 mm.

3. The method as in claim 1, in which said loading is in the range of 1–25 KN.

4. The method as in claim 1, in which said blocks are divided equally between said plates, each plate carrying at least six blocks, the blocks of one plate being superimposed over the spaces between the blocks of the other plate.

* * * * *